US010308052B2

(12) United States Patent
Morita

(10) Patent No.: US 10,308,052 B2
(45) Date of Patent: Jun. 4, 2019

(54) INKJET PRINTER WHICH STIFFENS SHEET

(71) Applicant: RISO KAGAKU CORPORATION, Tokyo (JP)

(72) Inventor: Yoshihisa Morita, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/892,571

(22) Filed: Feb. 9, 2018

(65) Prior Publication Data

US 2018/0244082 A1 Aug. 30, 2018

(30) Foreign Application Priority Data

Feb. 28, 2017 (JP) ..... 2017-036436

(51) Int. Cl.

| | |
|---|---|
| ***B41J 11/00*** | (2006.01) |
| ***B41J 11/02*** | (2006.01) |
| ***B41J 13/03*** | (2006.01) |
| ***B41J 2/145*** | (2006.01) |
| ***B65H 5/06*** | (2006.01) |
| ***B65H 5/38*** | (2006.01) |
| ***B41J 11/06*** | (2006.01) |

(52) U.S. Cl.

CPC ..... *B41J 13/03* (2013.01); *B41J 2/145* (2013.01); *B41J 11/005* (2013.01); *B41J 11/02* (2013.01); *B41J 11/06* (2013.01); *B65H 5/062* (2013.01); *B65H 5/38* (2013.01); *B65H 2301/5122* (2013.01); *B65H 2404/143* (2013.01); *B65H 2404/521* (2013.01); *B65H 2801/15* (2013.01)

(58) Field of Classification Search

CPC . B41J 13/03; B41J 2/145; B41J 11/02; B65H 5/062

See application file for complete search history.

(56) References Cited

U.S. PATENT DOCUMENTS

2006/0232653 A1 10/2006 Kawai et al.
2014/0146118 A1* 5/2014 Ito ..... B41J 11/006 347/104

FOREIGN PATENT DOCUMENTS

JP 2004-345791 12/2004

OTHER PUBLICATIONS

IP.com search (Year: 2018).*

* cited by examiner

*Primary Examiner* — Lisa Solomon
(74) *Attorney, Agent, or Firm* — Greenblum & Bernstein, P.L.C.

(57) ABSTRACT

An inkjet printer includes: at least one inkjet head configured to eject ink to a sheet and print an image; at least one stiffening conveyor configured to convey the sheet toward the at least one inkjet head in a conveyance direction while stiffening the sheet by deforming the sheet into a wave shape in a width direction orthogonal to the conveyance direction; and at least one platen arranged to face the at least one inkjet head and having a protrusion, the protrusion provided on a surface of the at least one platen facing the at least one inkjet head and configured to support a convex portion in the wave shape of the deformed sheet, the at least one platen configured to support the sheet while keeping the sheet deformed in the wave shape.

6 Claims, 10 Drawing Sheets

INKJET PRINTER WHICH STIFFENS SHEET

CROSS REFERENCE TO RELATED APPLICATION

This application is based upon and claims the benefit of priority from the prior Japanese Patent Application No. 2017-036436, filed on Feb. 28, 2017, the entire contents of which are incorporated herein by reference.

BACKGROUND

1. Technical Field

The disclosure relates to an inkjet printer configured to perform printing by ejecting ink from an inkjet head.

2. Related Art

There is known an inkjet printer configured to print an image by ejecting ink from an inkjet head to a sheet.

In an inkjet printer described in Japanese Patent Application Publication No. 2004-345791, a sheet is conveyed below an inkjet head by a conveyance roller and the like. Then, an image is printed on the sheet below the inkjet head by ejecting ink from the inkjet head.

SUMMARY

In the inkjet printer described above, for example, when the sheet is deformed to curl, the sheet conveyed below the inkjet head sometimes comes into contact with the inkjet head. When the sheet comes into contact with the inkjet head, the inkjet head is sometimes damaged.

The disclosure is directed to an inkjet printer which can reduce contact of a sheet with an inkjet head.

An inkjet printer in accordance with some embodiments includes at least one inkjet head, at least one stiffening conveyor, and at least one platen. The at least one inkjet head is configured to eject ink to a sheet and print an image. The at least one stiffening conveyor is configured to convey the sheet toward the at least one inkjet head in a conveyance direction while stiffening the sheet by deforming the sheet into a wave shape in a width direction orthogonal to the conveyance direction. The at least one platen is arranged to face the at least one inkjet head and has a protrusion. The protrusion is provided on a surface of the at least one platen facing the at least one inkjet head and is configured to support a convex portion in the wave shape of the deformed sheet. The at least one platen is configured to support the sheet while keeping the sheet deformed in the wave shape.

In the configuration described above, when the sheet is curled, the sheet is conveyed below the inkjet head with the curl being suppressed by the stiffening. As a result, contact of the sheet with the inkjet head can be reduced.

The at least one inkjet head may include: a first inkjet head configured to eject ink to the sheet and print a first image; and a second inkjet head arranged downstream of the first inkjet head in the conveyance direction and configured to eject ink to the sheet and print a second image. The at least one stiffening conveyor may include: a first stiffening conveyor configured to convey the sheet toward the first inkjet head in the conveyance direction while stiffening the sheet by deforming the sheet into a first wave shape in the width direction; and a second stiffening conveyor configured to convey the sheet toward the second inkjet in the conveyance direction while stiffening the sheet by deforming the sheet into a second wave shape in the width direction. The at least one platen may include: a first platen arranged to face the first inkjet head and having a first protrusion, the first protrusion provided on a surface of the first platen facing the first inkjet head and configured to support a first convex portion in the first wave shape of the sheet, the first platen configured to support the sheet while keeping the sheet deformed in the first wave shape; and a second platen arranged to face the second inkjet head and having a second protrusion, the second protrusion provided on a surface of the second platen facing the second inkjet head and configured to support a second convex portion in the second wave shape of the sheet, the second platen configured to support the sheet while keeping the sheet deformed in the second wave shape. A relationship of positions of the first convex portion and a first concave portion in the first wave shape of the sheet may be opposite in the width direction to a relationship of positions of the second convex portion and a second concave portion in the second wave shape of the sheet. The first inkjet head may be configured to perform printing on the first convex portion in the first wave shape of the sheet. The second inkjet head may be configured to perform printing on the second convex portion in the second wave shape of the sheet.

In the configuration described above, an increase of a head gap can be suppressed by avoiding printing on a concave portion of the sheet. Accordingly, it is possible to reduce the contact of the sheet with the inkjet head while suppressing a decrease of print quality.

The at least one stiffening conveyor may include: a conveyance roller elongated in the width direction; and stiffening rollers arranged along the width direction in such a zigzag pattern that the stiffening rollers are in contact with the conveyance roller at alternately upstream and downstream positions in the conveyance direction, the stiffening rollers configured to convey the sheet by nipping the sheet together with the conveyance roller while deforming the sheet into the wave shape.

The first stiffening conveyor may include: a first conveyance roller elongated in the width direction; and first stiffening rollers arranged along the width direction in such a zigzag pattern that the first stiffening rollers are in contact with the first conveyance roller at alternately upstream and downstream positions in the conveyance direction, the first stiffening rollers configured to convey the sheet by nipping the sheet together with the first conveyance roller while deforming the sheet into the first wave shape. The second stiffening conveyor may include: a second conveyance roller elongated in the width direction; and second stiffening rollers arranged along the width direction in such a zigzag pattern that the second stiffening rollers are in contact with the second conveyance roller at alternately upstream and downstream positions in the conveyance direction, the second stiffening rollers configured to convey the sheet by nipping the sheet together with the second conveyance roller while deforming the sheet into the second wave shape.

In the configuration described above, the sheet can be easily stiffened while being conveyed by a simple configuration.

The at least one stiffening conveyor may include: a conveyance roller with elastic portions formed of elastic members and non-elastic portions formed of non-elastic members alternately arranged along the width direction; first stiffening rollers arranged to be in contact with the elastic portions of the conveyance roller; and second stiffening rollers arranged to be in contact with the non-elastic portions of the conveyance roller. The at least one stiffening conveyor may be configured to convey the sheet by nipping the sheet with the conveyance roller, the first stiffening rollers, and the second stiffening rollers while deforming the sheet into the wave shape by pushing the sheet into the elastic portions with the first stiffening rollers.

The first stiffening conveyor may include: a first conveyance roller with elastic portions formed of elastic members and non-elastic portions formed of non-elastic members alternately arranged along the width direction; first stiffening rollers arranged to be in contact with the elastic portions of the first conveyance roller; and second stiffening rollers arranged to be in contact with the non-elastic portions of the first conveyance roller. The first stiffening conveyor may be configured to convey the sheet by nipping the sheet with the first conveyance roller, the first stiffening rollers, and the second stiffening rollers while deforming the sheet into the first wave shape by pushing the sheet into the elastic portions with the first stiffening rollers. The second stiffening conveyor may include: a second conveyance roller with elastic portions formed of elastic members and non-elastic portions formed of non-elastic members alternately arranged along the width direction; third stiffening rollers arranged to be in contact with the elastic portions of the second conveyance roller; and fourth stiffening rollers arranged to be in contact with the non-elastic portions of the second conveyance roller. The second stiffening conveyor may be configured to convey the sheet by nipping the sheet with the second conveyance roller, the third stiffening rollers, and the fourth stiffening rollers while deforming the sheet into the second wave shape by pushing the sheet into the elastic portions with the third stiffening rollers.

In the configuration described above, the sheet can be easily stiffened while being conveyed by a simple configuration.

DETAILED DESCRIPTION

Figure 1:
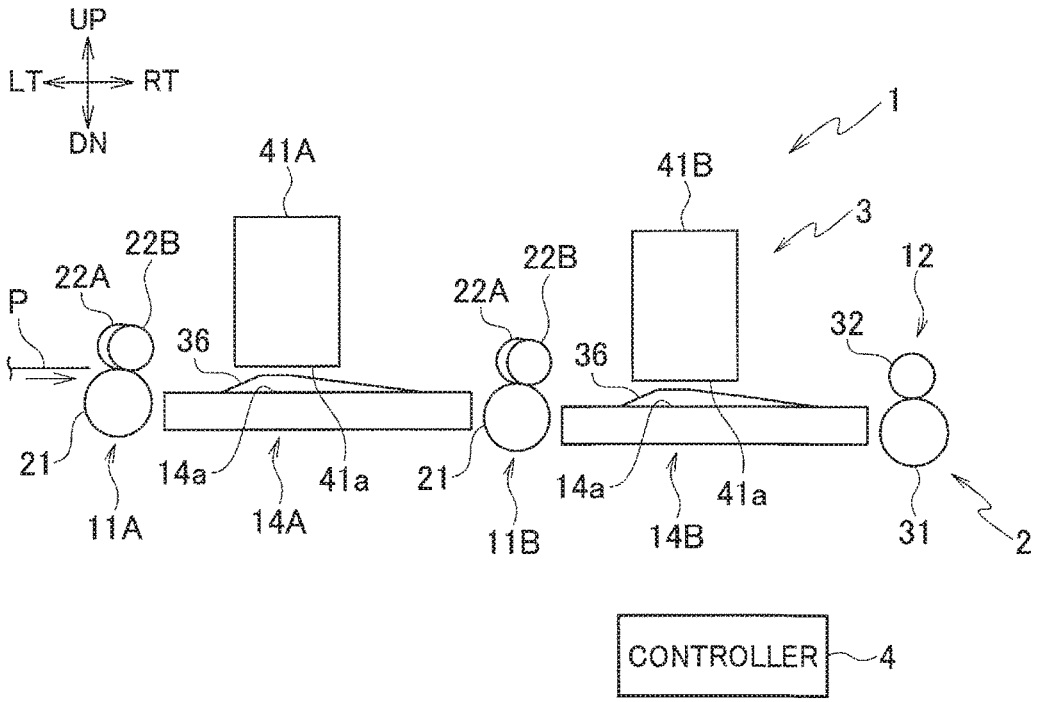
FIG. 1 is a schematic configuration diagram of an inkjet printer according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Figure 2:
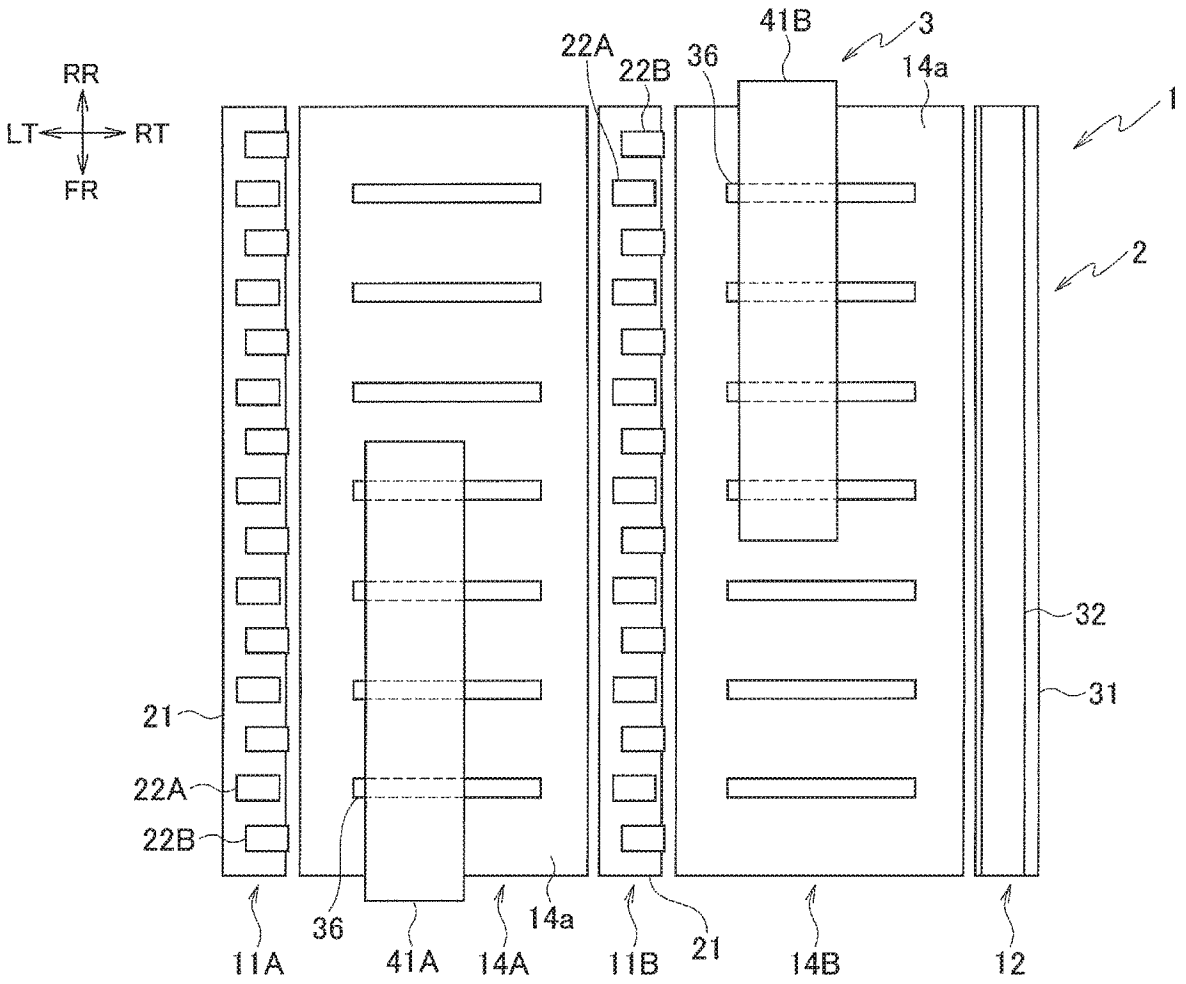
FIG. 2 is a plan view of the inkjet printer illustrated in FIG. 1.
Figure 3:
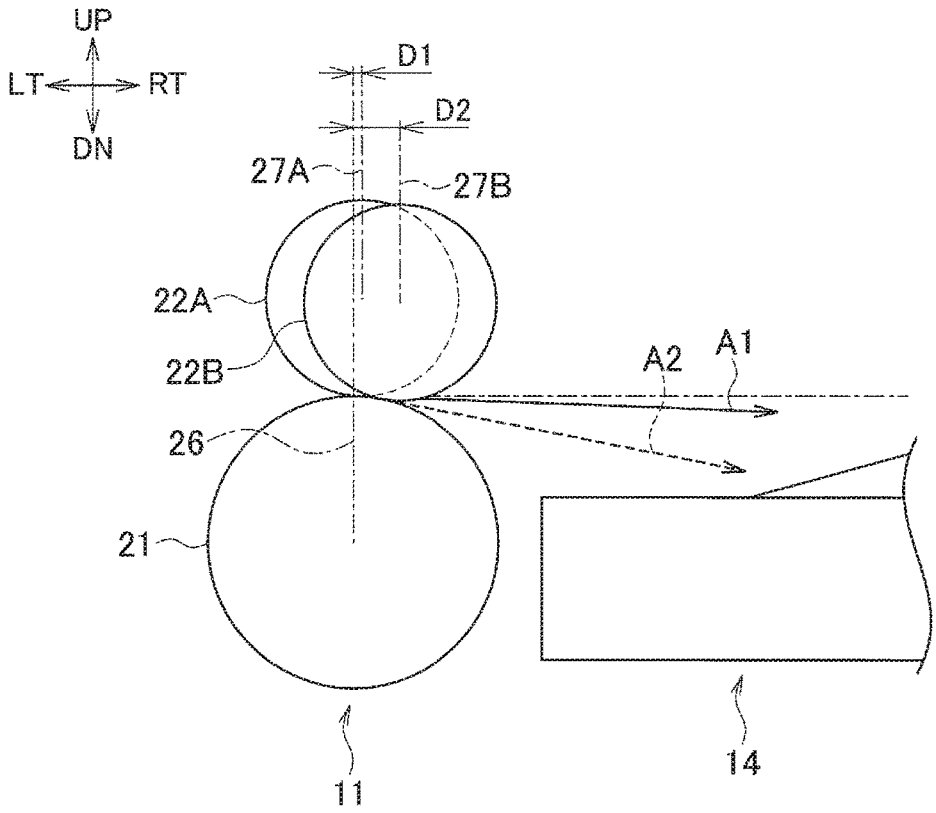
FIG. 3 is a front view of a stiffening conveyor in the inkjet printer illustrated in FIG. 1.
Figure 4:
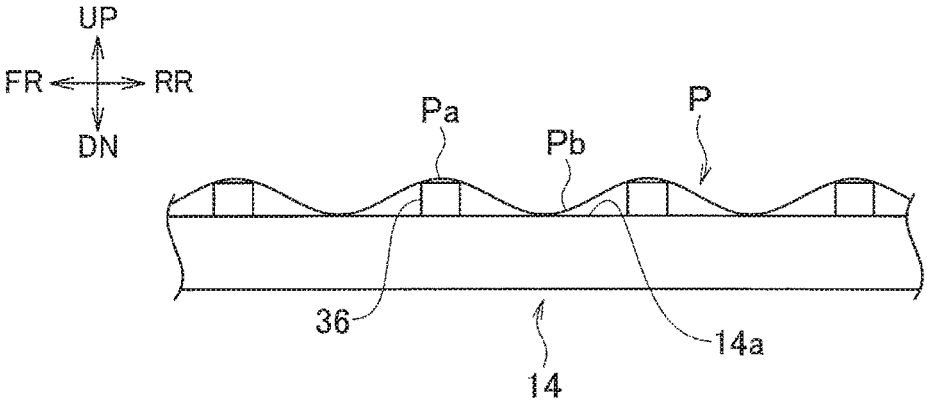
FIG. 4 is a partially enlarged diagram of a platen in the inkjet printer illustrated in FIG. 1.
Figure 5:
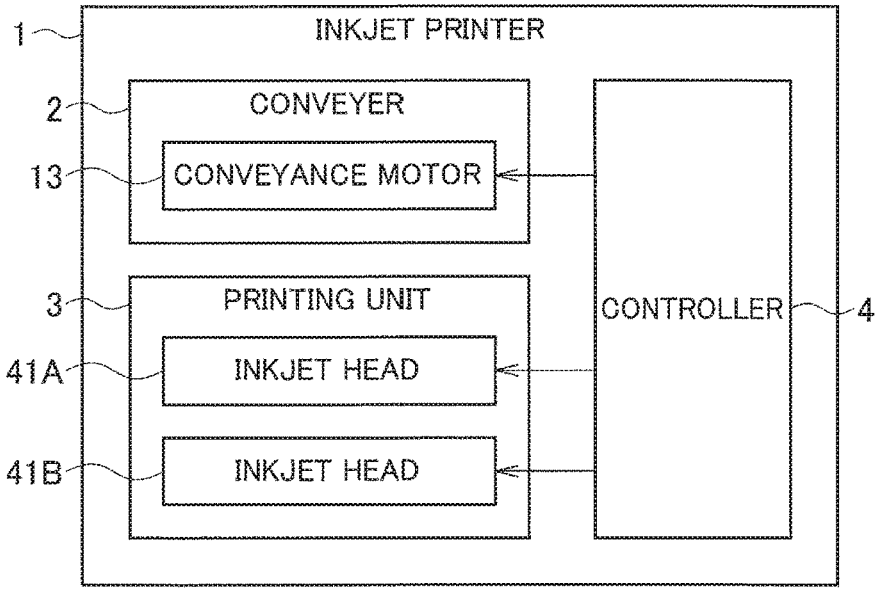
FIG. 5 is a control block diagram of the inkjet printer illustrated in FIG. 1.

FIG. 1 is a schematic configuration diagram of an inkjet printer according to a first embodiment. FIG. 2 is a plan view of the inkjet printer illustrated in FIG. 1. FIG. 3 is a front view of a stiffening conveyor in the inkjet printer illustrated in FIG. 1. FIG. 4 is a partially enlarged diagram of a platen in the inkjet printer illustrated in FIG. 1. FIG. 5 is a control block diagram of the inkjet printer illustrated in FIG. 1.

Note that a direction orthogonal to a sheet surface of FIG. 1 is referred to as front-rear direction and a direction toward a viewer is referred to as front direction. Moreover, up, down, left, and right in the sheet surface of FIG. 1 are referred to as up, down, left, and right directions. Furthermore, a direction from left to right in FIG. 1 is a conveyance direction of a sheet and upstream and downstream in the following description mean upstream and downstream in the conveyance direction of the sheet. In FIGS. 1 to 4, 7 to 9, 11, and 12, right, left, up, down, front, and rear directions are denoted by RT, LT, UP, DN, FR, and RR, respectively.

As illustrated in FIGS. 1 and 5, the inkjet printer 1 in the first embodiment includes a conveyor 2, a printing unit 3, and a controller 4.

The conveyor 2 conveys a sheet P which is a print medium. The conveyor 2 includes stiffening conveyors 11A, 11B, a conveyance roller pair 12, a conveyance motor 13, and platens 14A, 14B. Note that the stiffening conveyors 11A, 11B and the like are sometimes collectively referred to by omitting the alphabets attached to the reference numerals.

The stiffening conveyor 11A is arranged upstream of the inkjet head 41A. The stiffening conveyor 11B is arranged downstream of the inkjet head 41A and upstream of the inkjet head 41B. Each of the stiffening conveyors 11 includes a conveyance roller 21 and multiple stiffening rollers 22A, 22B.

The conveyance roller 21 conveys the sheet P by nipping the sheet P together with the stiffening rollers 22. The conveyance roller 21 is formed in a columnar shape elongating in the front-rear direction (width direction of the sheet P). The conveyance roller 21 is rotationally driven by drive force of the conveyance motor 13.

The stiffening rollers 22 convey the sheet P by nipping the sheet P together with the conveyance roller 21 and stiffen the sheet P by deforming the sheet P into the wave shape. The stiffening rollers 22 are arranged to be in contact with an upper portion of the conveyance roller 21 and follow the conveyance roller 21 to rotate.

The stiffening rollers 22 are arranged to be offset downstream relative to the conveyance roller 21. Specifically, as illustrated in FIG. 3, the stiffening rollers 22 are in contact with the conveyance roller 21, downstream of a center line 26 of the conveyance roller 21 which is parallel to an up-down direction.

Moreover, the multiple stiffening rollers 22 are arranged in such a zigzag pattern that the stiffening rollers 22 are in contact with the conveyance roller 21 at alternately upstream and downstream positions in the conveyance direction. Specifically, as illustrated in FIG. 3, there are stiffening rollers 22A whose offset amount is D1 and stiffening rollers 22B whose offset amount is D2 greater than D1. Moreover, as illustrated in FIG. 2, the stiffening rollers 22A and the stiffening rollers 22B are alternately arranged along the front-rear direction.

The offset amount D1 is a distance between the center line 26 of the conveyance roller 21 and a center line 27A of each stiffening roller 22A which is parallel to the up-down direction. The offset amount D2 is a distance between the center line 26 of the conveyance roller 21 and a center line 27B of each stiffening roller 22B which is parallel to the up-down direction.

As described above, since the stiffening rollers 22 are arranged to be offset downstream relative to the conveyance roller 21, common tangents of the conveyance roller 21 and the stiffening rollers 22 at nipping points are straight lines titled downward toward the downstream side. Specifically, directions in which the conveyance roller 21 and the stiffening rollers 22 send out the sheet P are tilted downward relative to the horizontal direction as illustrated by the arrows A1, A2 in FIG. 3. In FIG. 3, the arrow A1 illustrates the send-out direction of the sheet P at the positions of the stiffening rollers 22A. The arrow A2 illustrates the send-out direction of the sheet P at the positions of the stiffening rollers 22B.

The conveyance roller 21 and the stiffening rollers 22 send out the sheet P downward and the sheet P is thereby conveyed toward a position below the inkjet head 41 to be pushed against the platen 14. This suppresses lifting of the sheet P from the platen 14.

Moreover, the send-out direction (arrow A1) of the sheet P at the positions of the stiffening rollers 22A is different from the send-out direction (arrow A2) of the sheet P at the positions of the stiffening rollers 22B, and the sheet P is thereby deformed into the wave shape in the width direction to be stiffened.

The conveyance roller pair 12 conveys the sheet P subjected to printing by the printing unit 3 downstream by nipping the sheet P. The conveyance roller pair 12 is arranged downstream of the platen 14B. The conveyance roller pair 12 includes a conveyance roller 31 and a following roller 32.

The conveyance roller 31 is formed in a cylindrical shape elongating in the front-rear direction. The conveyance roller 31 is rotationally driven by the drive force of the conveyance motor 13. The following roller 32 is formed in a cylindrical shape elongated to have the same length as the conveyance roller 31. The following roller 32 is in contact with the conveyance roller 31 and follows the conveyance roller 31 to rotate.

The platens 14A, 14B support the sheet P conveyed below the inkjet heads 41A, 41B, respectively. The platens 14A, 14B are arranged below the inkjet heads 41A, 41B to face nozzle surfaces 41*a* of the inkjet heads 41A, 41B, respectively. The platen 14B is arranged at a position below the platen 14A.

Each of the platens 14 is formed in a plate shape. Multiple ribs (protrusions) 36 are formed on an upper surface 14*a* of the platen 14 facing the nozzle surface 41*a* of the inkjet head 41.

As illustrated in FIG. 4, the ribs 36 are formed to protrude upward from the upper surface 14*a* of the platen 14. The ribs 36 are portions which support mountain portions (convex portions) Pa of the sheet P stiffened by being deformed into the wave shape by the stiffening conveyor 11. Here, the mountain portions Pa of the sheet P stiffened by being deformed into the wave shape are portions curving to protrude upward in the sheet P. Portions curving to protrude downward in the sheet P stiffened by being deformed into the wave shape are referred to as valley portions (concave portions) Pb. The cross section of the sheet P along the width direction has the wave shape due to the mountain portions Pa and the valley portions Pb of the sheet P.

The multiple ribs 36 are arranged at certain intervals in the front-rear direction. Moreover, in the platens 14A, 14B, the ribs 36 are arranged downstream of the respective stiffening rollers 22A whose offset amount is D1 in the stiffening conveyors 11A, 11B. In the platens 14A, 14B, the ribs 36 thus support the respective mountain portions Pa of the sheet P stiffened by being deformed into the wave shape by the stiffening conveyors 11A, 11B.

Since the ribs 36 protrude from the upper surface 14*a*, portions around the ribs 36 in the platen 14 are lower than the ribs 36. When the sheet P stiffened by being deformed into the wave shape by the stiffening conveyor 11 is conveyed to the platen 14, the mountain portions Pa of the sheet P pass the ribs 36 and the valley portions Pb pass the portions lower than the ribs 36. The sheet P is thus kept in a wave shape state. In other words, the platen 14 supports the sheet P while keeping the sheet P in the wave shape state.

The printing unit 3 prints an image on the sheet P conveyed by the conveyor 2. The printing unit 3 includes the inkjet heads 41A, 41B.

Each of the inkjet heads 41 prints the image by ejecting ink to the conveyed sheet P. The inkjet head 41 has multiple nozzles (not illustrated) which are opened on the nozzle surface 41*a* being a lower surface of the inkjet head 41 and which are arranged along a main scanning direction (front-rear direction), and eject the ink from the nozzles.

The inkjet heads 41A, 41B are arranged at a certain interval in a sub-scanning direction (left-right direction) which is the conveyance direction of the sheet P, and the inkjet head 41A is arranged on the upstream side while the inkjet head 41B is arranged on the downstream side. In the main scanning direction (front-rear direction), the inkjet head 41B is shifted to the rear side relative to the inkjet head 41A. In other words, the inkjet heads 41A, 41B are arranged in zigzag. Thus, the inkjet head 41A performs printing on a front region of the sheet P while the inkjet head 41B performs printing on a rear region of the sheet P.

The controller 4 controls operations of units in the inkjet printer 1. The controller 4 includes a CPU, a RAM, a ROM, a hard disk drive, and the like.

Next, operations of the inkjet printer 1 are described.

When printing is to be performed in the inkjet printer 1, first, the controller 4 starts the drive of the stiffening conveyors 11A, 11B and the conveyance roller pair 12 by using the conveyance motor 13.

The sheet P is conveyed to the conveyor 2 from the upstream side and is then conveyed in the conveyor 2 while being nipped by the stiffening conveyors 11A, 11B and the conveyance roller pair 12.

Figure 6:
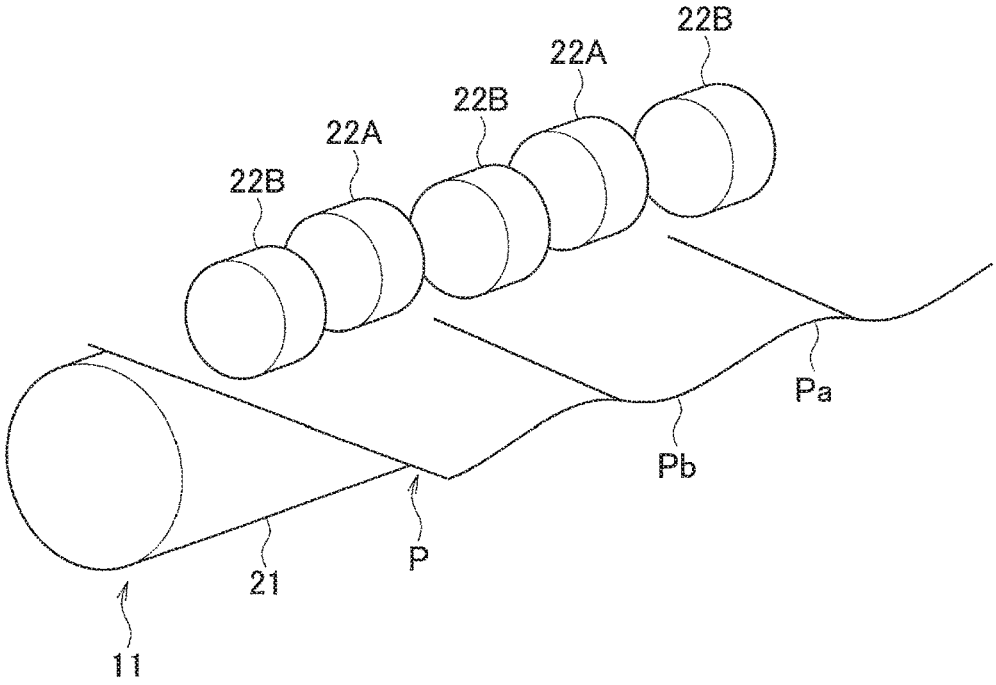
FIG. 6 is a diagram illustrating how a sheet is stiffened by the stiffening conveyor.

In this case, in each of the stiffening conveyors 11, the mountain portions Pa and the valley portions Pb are formed in the sheet Pas illustrated in FIG. 6 due to the difference between the send-out direction of the sheet P by the stiffening rollers 22A and that by the stiffening rollers 22B. Specifically, the mountain portions Pa are formed at the positions where the sheet P is sent out by the stiffening rollers 22A and the valley portions Pb are formed at the positions where the sheet P is sent out by the stiffening rollers 22B. The sheet P is thereby stiffened by being deformed into the wave shape in which the mountain portions Pa and the valley portions Pb are alternately formed in the width direction.

As illustrated in FIG. 4, the sheet P stiffened by being deformed into the wave shape travels downstream below the inkjet head 41 with the mountain portions Pa being supported by the ribs 36 and the valley portions Pb being supported by the upper surface 14*a* of the platen 14. The sheet P is thereby conveyed below the inkjet head 41 while being kept in a state stiffened by being deformed into the wave shape.

The controller 4 drives the inkjet heads 41A, 41B based on image data of a print target and causes the inkjet heads 41A, 41B to eject the ink to the sheet P conveyed by the conveyor 2. The image is thereby printed on the sheet P. The sheet P subjected to printing by the inkjet heads 41A, 41B is conveyed to a sheet discharger (not illustrated) by the conveyance roller pair 12.

As described above, in the inkjet printer 1, the stiffening conveyors 11 convey the sheet P to the inkjet heads 41 while stiffening the sheet P by deforming it into the wave shape. The platens 14 support the sheet P below the inkjet heads while keeping the sheet P in the wave shape state. Accordingly, when the sheet P is curled, the sheet P is conveyed below the inkjet heads 41 with the curl being suppressed by the stiffening. As a result, the inkjet printer 1 can reduce the contact of the sheet P with the inkjet heads 41.

In addition, in the inkjet printer 1, the multiple stiffening rollers 22 are arranged in such a zigzag pattern that the stiffening rollers 22 are in contact with the conveyance roller 21 at alternately the upstream and downstream portions in the conveyance direction. Moreover, the conveyance roller 21 and the stiffening rollers 22 stiffen the sheet P while conveying the sheet P by nipping it. The sheet P can be thereby easily stiffened while being conveyed by a simple configuration.

Second Embodiment

Figure 7:
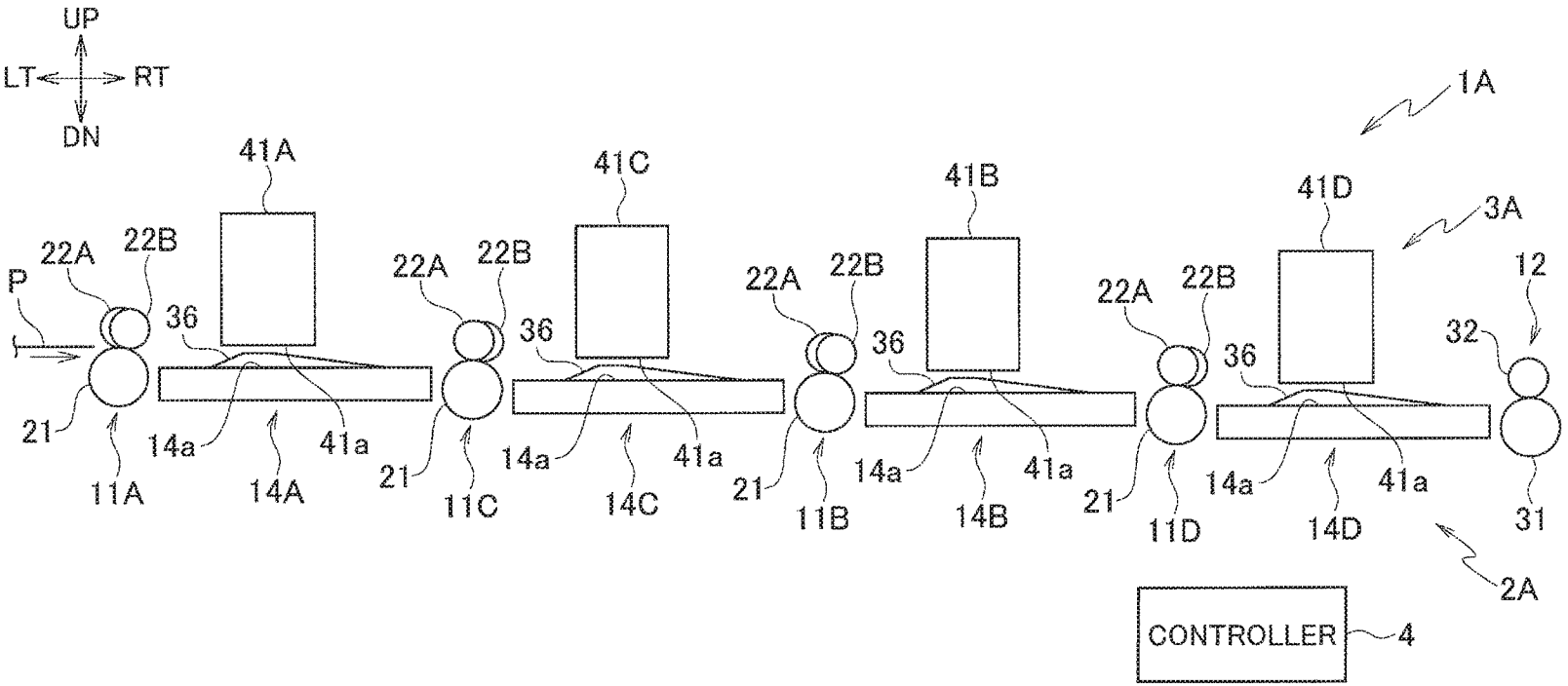
FIG. 7 is a schematic configuration diagram of an inkjet printer according to a second embodiment.
Figure 8:
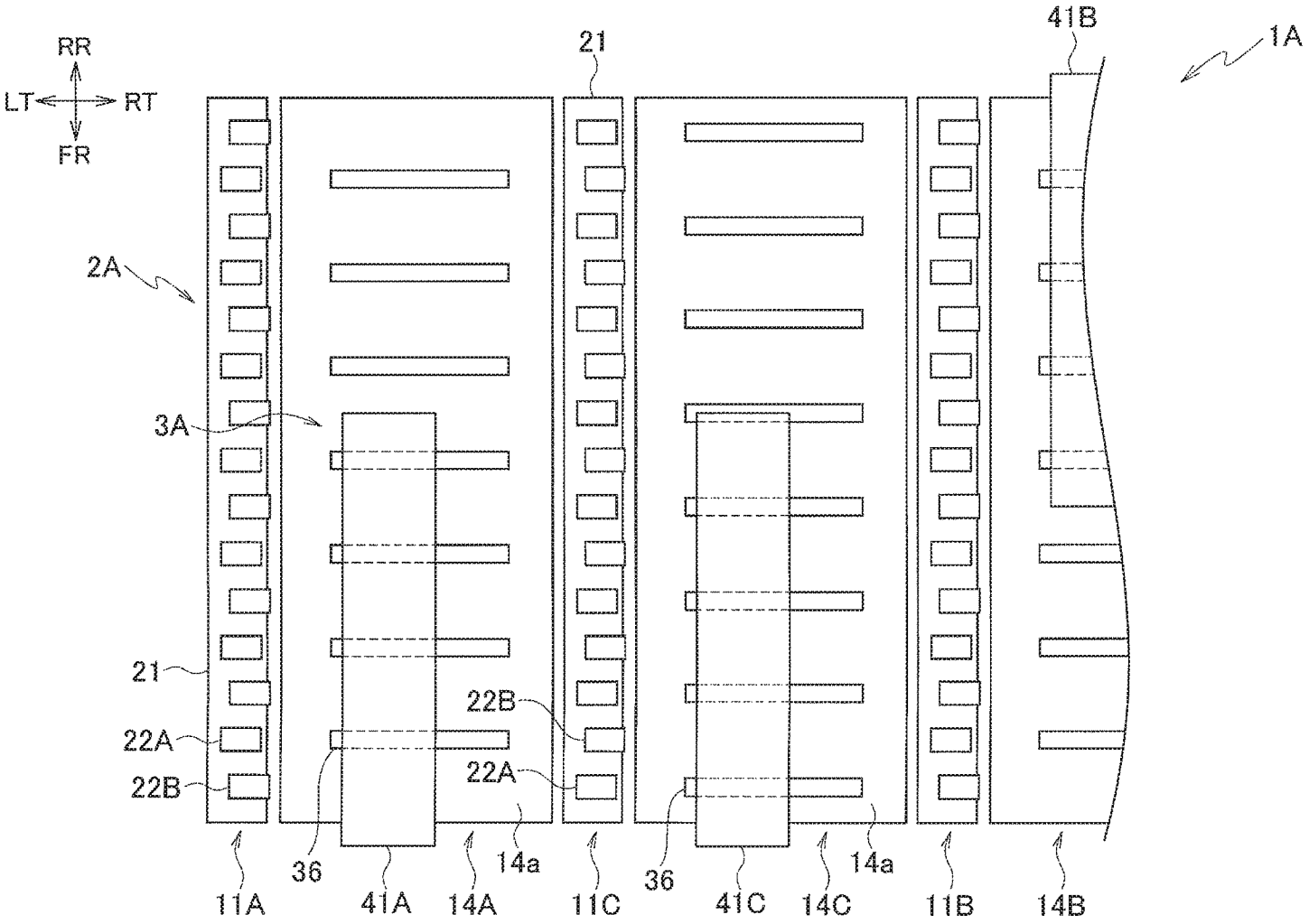
FIG. 8 is a plan view of an upstream portion of the inkjet printer illustrated in FIG. 7.
Figure 9:
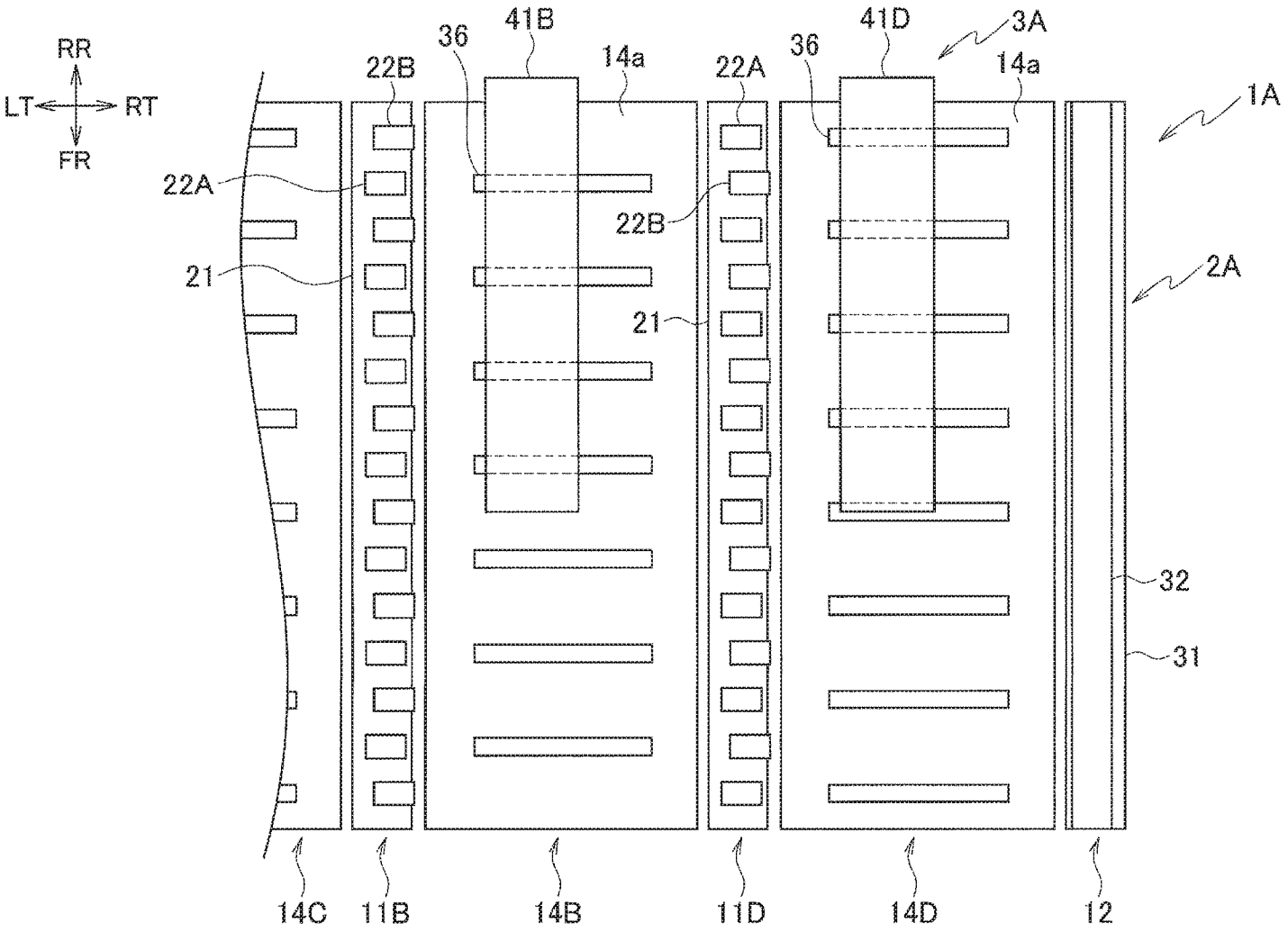
FIG. 9 is a plan view of a downstream portion of the inkjet printer illustrated in FIG. 7.

FIG. 7 is a schematic configuration diagram of an inkjet printer 1A according to a second embodiment. FIG. 8 is a plan view of an upstream portion of the inkjet printer 1A illustrated in FIG. 7. FIG. 9 is a plan view of a downstream portion of the inkjet printer 1A illustrated in FIG. 7.

As illustrated in FIG. 7, the inkjet printer 1A according to the second embodiment has a configuration in which the conveyor 2 and the printing unit 3 in the inkjet printer 1 of the first embodiment are replaced with a conveyor 2A and a printing unit 3A, respectively.

The conveyor 2A has a configuration in which stiffening conveyors 11C, 11D and platens 14C, 14D are added to the conveyor 2 of the first embodiment.

The stiffening conveyors 11C, 11D convey the sheet P to inkjet heads 41C, 41D of the printing unit 3 to be described later while stiffening the sheet P by deforming it into the wave shape as in the stiffening conveyors 11A, 11B. The stiffening conveyor 11C is arranged downstream of the inkjet head 41A and upstream of the inkjet head 41C. The stiffening conveyor 11D is arranged downstream of the inkjet head 41B and upstream of the inkjet head 41D.

The stiffening conveyors 11C, 11D have a configuration in which the relationship of the positions of the stiffening rollers 22A, 22B in the front-rear direction (width direction of the sheet P) is reversed from that in the stiffening conveyors 11A, 11B.

Specifically, the stiffening rollers 22B of the stiffening conveyor 11C are arranged downstream of the stiffening rollers 22A of the stiffening conveyor 11A, respectively, and the stiffening rollers 22A of the stiffening conveyors 11C are arranged downstream of the stiffening rollers 22B of the stiffening conveyor 11A, respectively. The stiffening conveyors 11A, 11C thereby stiffen the sheet P by deforming it into wave shapes opposite in the relationship of the positions of the mountain portions Pa and the valley portions Pb in the width direction.

Moreover, the stiffening rollers 22B of the stiffening conveyor 11D are arranged downstream of the stiffening rollers 22A of the stiffening conveyor 11B, respectively, and the stiffening rollers 22A of the stiffening conveyors 11D are arranged downstream of the stiffening rollers 22B of the stiffening conveyor 11B, respectively. The stiffening conveyors 11B, 11D thereby stiffen the sheet P by deforming it into wave shapes opposite in the relationship of the positions of the mountain portions Pa and the valley portions Pb in the width direction.

Platens 14C, 14D support the sheet P conveyed below the inkjet heads 41C, 41D to be described later. The platens 14C, 14D are arranged below the inkjet heads 41C, 41D to face nozzle surfaces 41*a* of the inkjet heads 41C, 41D, respectively. The platen 14C is arranged at a position below the platen 14A and above the platen 14B. The platen 14D is arranged at a position below the platen 14B.

The platens 14C, 14D have a configuration in which the positions of the ribs 36 are changed from those in the platens 14A, 14B. Specifically, the ribs 36 of the platen 14C are arranged downstream of the stiffening rollers 22A of the stiffening conveyor 11C, respectively. The ribs 36 of the platen 14C thereby support the mountain portions Pa of the sheet P stiffened by being deformed into the wave shape by the stiffening conveyor 11C. The ribs 36 of the platen 14D are arranged downstream of the stiffening rollers 22A of the stiffening conveyor 11D. The ribs 36 of the platen 14D thereby support the mountain portions Pa of the sheet P stiffened by being deformed into the wave shape by the stiffening conveyor 11D.

The printing unit 3A has a configuration in which the inkjet heads 41C, 41D are added to the printing unit 3 of the first embodiment.

The inkjet heads 41C, 41D each have multiple nozzles which are opened on the nozzle surface 41*a* and which are arranged along the main scanning direction (front-rear direction) as in the inkjet heads 41A, 41B, and eject the ink from the nozzles.

The inkjet head 41C is paired with the inkjet head 41A and prints an image in a front region of the sheet P. The inkjet head 41C is arranged downstream of and away from the inkjet head 41A. The inkjet head 41C is arranged at the same position as the inkjet head 41A in the front-rear direction.

The inkjet head 41D is paired with the inkjet head 41B and prints an image in a rear region of the sheet P. The inkjet head 41D is arranged downstream of and away from the inkjet head 41B. The inkjet head 41D is arranged at the same position as the inkjet head 41B in the front-rear direction.

The inkjet heads 41A to 41D of the printing unit 3A perform printing on the mountain portions Pa of the sheet P stiffened by being deformed into the wave shapes by the stiffening conveyors 11A to 11D corresponding respectively to the inkjet heads 41A to 41D.

Next, operations of the inkjet printer 1A are described.

When printing is to be performed in the inkjet printer 1A, first, the controller 4 starts the drive of the stiffening conveyors 11A to 11D and the conveyance roller pair 12 by using the conveyance motor 13.

The sheet P is conveyed to the conveyor 2A from the upstream side and is then conveyed in the conveyor 2A while being nipped by the stiffening conveyors 11A to 11D and the conveyance roller pair 12.

The sheet P conveyed in the conveyor 2A is stiffened by the stiffening conveyors 11A to 11D and is conveyed below the inkjet heads 41A to 41D while being kept in the stiffened state by the platens 14A to 14D.

In this case, as described above, the stiffening conveyors 11A, 11C stiffen the sheet P by deforming it into the wave shapes opposite in the relationship of the positions of the mountain portions Pa and the valley portions Pb. Moreover, the controller 4 controls the inkjet heads 41A, 41C to cause the inkjet heads 41A, 41C to perform printing on the mountain portions Pa of the sheet P.

Figure 10:
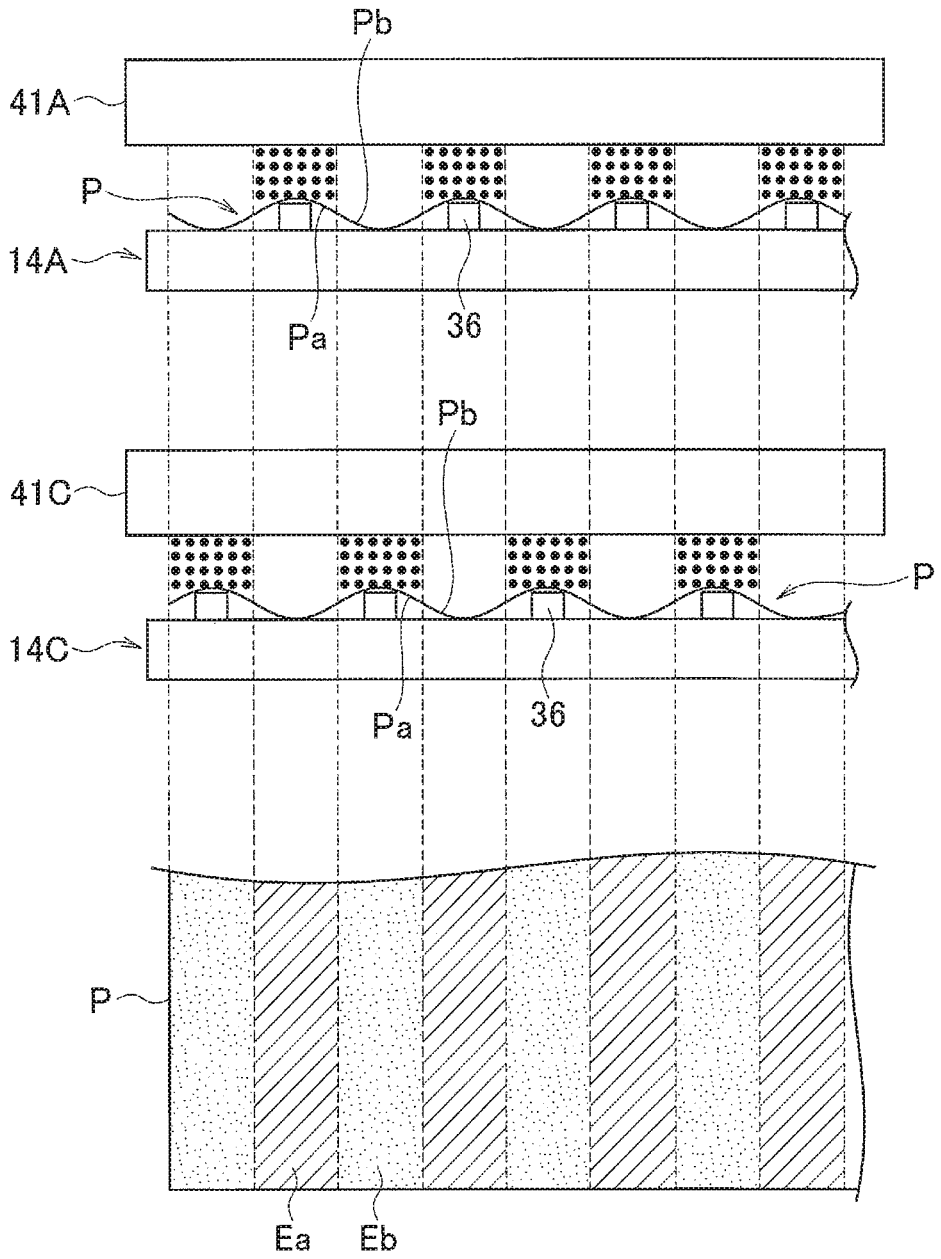
FIG. 10 is a diagram explaining print regions of inkjet heads in the inkjet printer illustrated in FIG. 7.

As illustrated in FIG. 10, regions Ea corresponding to the mountain portions Pa formed when the sheet P passes below the inkjet head 41A are subjected to printing by the ink ejection from the inkjet head 41A. Regions Eb corresponding to the mountain portions Pa formed when the sheet P passes below the inkjet head 41C are subjected to printing by the ink ejection from the inkjet head 41C. Here, since the stiffening conveyor 11A, 11C stiffen the sheet P such that the relationship of the positions of the mountain portions Pa and the valley portions Pb in the stiffening conveyor 11A is opposite to that in the stiffening conveyor 11C, the regions Ea, Eb are regions alternately provided in the width direction of the sheet P.

As described above, the inkjet head 41A, 41C perform, as a pair, printing on the regions Ea, Eb assigned thereto and thereby print the image in the front region of the sheet P.

Furthermore, as described above, the stiffening conveyors 11B, 11D also stiffen the sheet P by deforming it into the wave shapes opposite in the relationship of the positions of the mountain portions Pa and the valley portions Pb. Moreover, the controller 4 controls the inkjet heads 41B, 41D to cause the inkjet heads 41B, 41D to perform printing on the mountain portions Pa of the sheet P.

The inkjet heads 41B, 41D thereby perform, as a pair, printing on the regions corresponding to the mountain portions Pa formed when the sheet P passes below the inkjet heads 41B, 41D as in the inkjet heads 41A, 14C, and thereby print the image in the rear region of the sheet P.

The sheet P subjected to the printing by the inkjet heads 41A to 41D are conveyed to the sheet discharger (not illustrated) by the conveyance roller pair 12.

As described above, in the inkjet printer 1A, the stiffening conveyor 11A corresponding to the inkjet head 41A which is an upstream one of the paired inkjet heads 41A, 41C and the stiffening conveyor 11C corresponding to the inkjet head 41C which a downstream one of the paired inkjet heads 41A, 41C stiffen the sheet P such that the relationship of the positions of the mountain portions Pa and the valley portions Pb in the stiffening conveyor 11A is opposite to that in the stiffening conveyor 11C. Similarly, the stiffening conveyor 11B corresponding to the inkjet head 41B which is an upstream one of the paired inkjet heads 41B, 41D and the stiffening conveyor 11D corresponding to the inkjet head 41D which a downstream one of the paired inkjet heads 41B, 41D stiffen the sheet P such that the relationship of the positions of the mountain portions Pa and the valley portions Pb in the stiffening conveyor 11B is opposite to that in the stiffening conveyor 11D. Moreover, the inkjet heads 41A to 41D perform printing on the mountain portions Pa of the sheet P stiffened by being deformed into the wave shapes by the stiffening conveyors 11A to 11D corresponding respectively to the inkjet heads 41A to 41D. The inkjet heads 41A to 41D perform printing on the entire sheet P by performing printing on the mountain portions Pa of the sheet P.

In an inkjet method, the larger the head gap being a distance between the inkjet head 41 and the sheet P is, the more likely that landing positions of ink will deviate. The deviation of landing positions of ink causes a decrease of print quality. In view of this, in the inkjet printer 1A, the inkjet heads 41A to 41D perform printing on the mountain portions Pa of the sheet P and avoid printing on the valley portions Pb, and an increase of the head gap is thus suppressed. Accordingly, the inkjet printer 1A can reduce contact of the sheet P with the inkjet heads 41 while suppressing the decrease of print quality.

Third Embodiment

Figure 11:
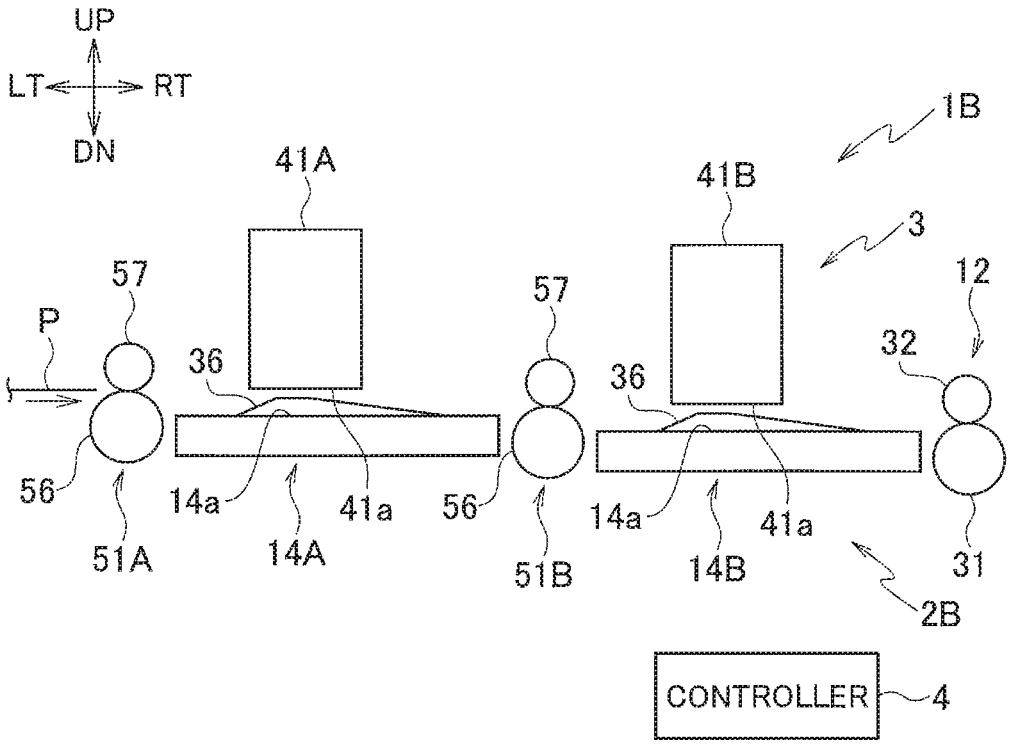
FIG. 11 is a schematic configuration diagram of an inkjet printer according to a third embodiment.
Figure 12:
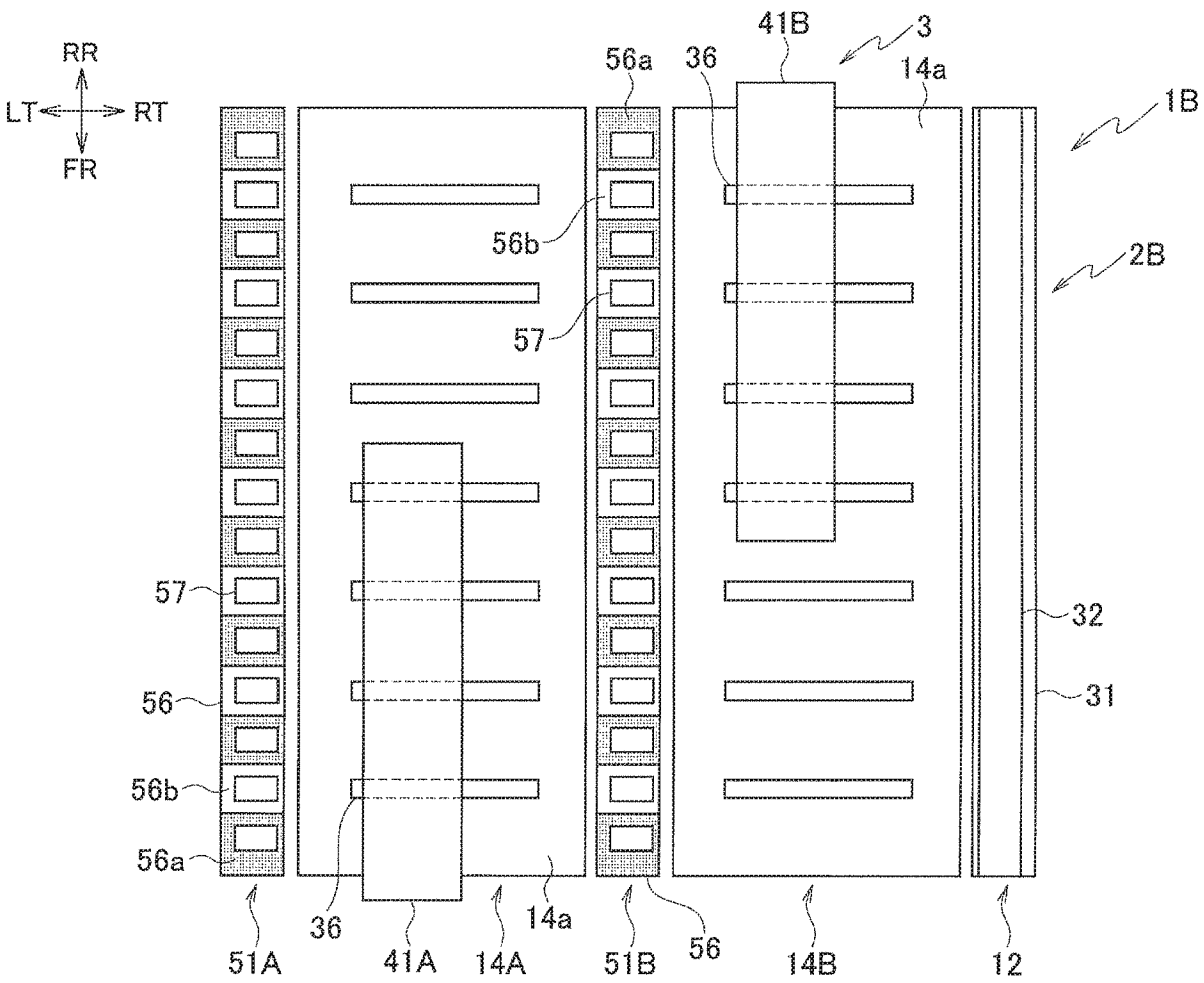
FIG. 12 is a plan view of the inkjet printer illustrated in FIG. 11.

FIG. 11 is a schematic configuration diagram of an inkjet printer 1B according to a third embodiment. FIG. 12 is a plan view of the inkjet printer 1B illustrated in FIG. 11.

As illustrated in FIG. 11, the inkjet printer 1B according to the third embodiment has a configuration different from the inkjet printer 1 of the first embodiment in that the conveyor 2 is replaced with a conveyor 2B.

The conveyor 2B has a configuration in which the stiffening conveyors 11A, 11B of the conveyor 2 in the first embodiment are replaced with stiffening conveyors 51A, 51B.

The stiffening conveyors 51 each include a conveyance roller 56 and multiple stiffening rollers 57.

The conveyance roller 56 conveys the sheet P by nipping the sheet P together with the stiffening rollers 57. The conveyance roller 56 is formed in a cylindrical shape elongating in the front-rear direction (width direction of the sheet P). The conveyance roller 56 includes multiple elastic portions 56*a* and multiple non-elastic portions 56*b*.

The elastic portions 56*a* are portions formed of elastic members such as rubber members. The non-elastic portions 56*b* are portions formed of non-elastic members such as metal members. The elastic portions 56*a* and the non-elastic portions 56*b* are alternately arranged along the front-rear direction (width direction of the sheet P).

The stiffening rollers 57 convey the sheet P by nipping the sheet P together with the conveyance roller 56 and stiffen the sheet P by deforming it into a wave shape. The stiffening rollers 57 are arranged to be in contact with an upper portion of the conveyance roller 56 and follow the conveyance roller 56 to rotate.

The stiffening rollers 57 are arranged to be in contact respectively with the elastic portions 56*a* and the non-elastic portions 56*b* of the conveyance roller 56. The stiffening rollers 57 arranged on the elastic portions 56*a* are in contact with the elastic portions 56*a* at such nipping pressure that surfaces of the elastic portions 56*a* are deformed and recessed. At the positions of the elastic portions 56*a*, the stiffening rollers 57 thus push the sheet P into the elastic portions 56*a* when the sheet P is conveyed while being nipped by the conveyance roller 56 and the stiffening rollers 57. Meanwhile, at the positions of the non-elastic portions 56*b*, since the non-elastic portions 56*b* do not deform, the sheet P is not pushed into the non-elastic portions 56*b*. Accordingly, the sheet P is stiffened by being deformed into the wave shape such that the valley portions Pb are formed at the positions of the elastic portions 56*a* and the mountain portions Pa are formed at the positions of the non-elastic portions 56*b*.

In the platens 14A, 14B, the ribs 36 are arranged downstream of the non-elastic portions 56*b* of the stiffening conveyors 51A, 51B. The ribs 36 thereby support the mountain portions Pa of the sheet P stiffened by being deformed into the wave shape by the stiffening conveyors 51A, 51B, in the platens 14A, 14B.

As described above, in the third embodiment, the stiffening conveyors 51 each include the conveyance roller 56 having the elastic portions 56*a* and the non-elastic portions 56*b* which are arranged alternately and the multiple stiffening rollers 57 arranged to be in contact respectively with the elastic portions 56*a* and the non-elastic portions 56*b* of the conveyance roller 56. Moreover, the sheet P is conveyed while being nipped by the conveyance roller 56 and the multiple stiffening rollers 57, and the stiffening rollers 57 in contact with the elastic portions 56*a* of the conveyance roller 56 push the sheet P into the elastic portions 56*a* to stiffen the sheet P by deforming it into the wave shape. The sheet P can be thereby easily stiffened while being conveyed by a simple configuration.

Other Embodiments

The stiffening conveyors 11 in the second embodiment may be replaced with the stiffening conveyors 51 in the third embodiment. In this case, it is only necessary to set the relationship of the positions of the elastic portions 56*a* and the non-elastic portions 56*b* in the stiffening conveyor 51 corresponding to the inkjet head 41A opposite to that in the stiffening conveyor 51 corresponding to the inkjet head 41C. Similarly, it is only necessary to set the relationship of the positions of the elastic portions 56*a* and the non-elastic portions 56*b* in the stiffening conveyor 51 corresponding to the inkjet head 41B opposite to that in the stiffening conveyor 51 corresponding to the inkjet head 41D.

In an inkjet printer, a sheet subjected to printing is more likely to curl and come into contact with an inkjet head while a sheet not subjected to printing is less likely to curl. Accordingly, an inkjet printer in which multiple inkjet heads are arranged in the sub-scanning direction parallel to one another may be configured such that no stiffening of the sheet in the aforementioned embodiments is performed for the most-upstream inkjet head which performs printing on a sheet not subjected to printing and the stiffening of the sheet by the stiffening conveyors 11 or the stiffening conveyors 51 and the keeping of the sheet in the stiffened state by the platens 14 in the aforementioned embodiments are applied to the inkjet heads other than the most-upstream inkjet head. This can reduce the contact of the sheet with the inkjet heads other than the most-upstream inkjet head in which the contact with the sheet due to curling thereof is more likely to occur.

Moreover, the inkjet printer may be configured such that no stiffening of the sheet is performed for the most-upstream inkjet head which performs printing on a sheet not subjected to printing and the second embodiment is applied to the inkjet heads other than the most-upstream inkjet head. Specifically, in this case, the inkjet heads other than the most-upstream inkjet head are configured as pairs of two inkjet heads. Moreover, for each pair of inkjet heads, the stiffening conveyors 11 or the stiffening conveyors 51 in the aforementioned embodiments stiffen the sheet such that the relationship of the positions of the mountain portions and the valley portions in one stiffening conveyor is opposite to that in the other stiffening conveyor, and the platens 14 keep the sheet in the stiffened state. Furthermore, the pair of inkjet heads performs printing on the mountain portions of the sheet stiffened by being deformed into the wave shapes.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

at least one inkjet head configured to eject ink to a sheet and print an image;

rollers configured to convey the sheet toward the at least one inkjet head in a conveyance direction while stiffening the sheet by deforming the sheet into a wave shape in a width direction orthogonal to the conveyance direction; and at least one platen arranged to face the at least one inkjet head and having a protrusion, the protrusion provided on a surface of the at least one platen facing the at least one inkjet head and configured to support a convex portion in the wave shape of the deformed sheet, the at least one platen configured to support the sheet while keeping the sheet deformed in the wave shape.

2. An inkjet printer comprising:

at least one inkjet head configured to eject ink to a sheet and print an image;

at least one stiffening conveyor configured to convey the sheet toward the at least one inkjet head in a conveyance direction while stiffening the sheet by deforming the sheet into a wave shape in a width direction orthogonal to the conveyance direction; and at least one platen arranged to face the at least one inkjet head and having a protrusion, the protrusion provided on a surface of the at least one platen facing the at least one inkjet head and configured to support a convex portion in the wave shape of the deformed sheet, the at least one platen configured to support the sheet while keeping the sheet deformed in the wave shape, wherein the at least one inkjet head comprises:

a first inkjet head configured to eject ink to the sheet and print a first image; and a second inkjet head arranged downstream of the first inkjet head in the conveyance direction and configured to eject ink to the sheet and print a second image, the at least one stiffening conveyor comprises:

a first stiffening conveyor configured to convey the sheet toward the first inkjet head in the conveyance direction while stiffening the sheet by deforming the sheet into a first wave shape in the width direction; and a second stiffening conveyor configured to convey the sheet toward the second inkjet in the conveyance direction while stiffening the sheet by deforming the sheet into a second wave shape in the width direction, the at least one platen comprises:

a first platen arranged to face the first inkjet head and having a first protrusion, the first protrusion provided on a surface of the first platen facing the first inkjet head and configured to support a first convex portion in the first wave shape of the sheet, the first platen configured to support the sheet while keeping the sheet deformed in the first wave shape; and a second platen arranged to face the second inkjet head and having a second protrusion, the second protrusion provided on a surface of the second platen facing the second inkjet head and configured to support a second convex portion in the second wave shape of the sheet, the second platen configured to support the sheet while keeping the sheet deformed in the second wave shape, a relationship of positions of the first convex portion and a first concave portion in the first wave shape of the sheet is opposite in the width direction to a relationship of positions of the second convex portion and a second concave portion in the second wave shape of the sheet, the first inkjet head is configured to perform printing on the first convex portion in the first wave shape of the sheet, and the second inkjet head is configured to perform printing on the second convex portion in the second wave shape of the sheet.

3. An inkjet printer comprising:

at least one inkjet head configured to eject ink to a sheet and print an image;

at least one stiffening conveyor configured to convey the sheet toward the at least one inkjet head in a conveyance direction while stiffening the sheet by deforming the sheet into a wave shape in a width direction orthogonal to the conveyance direction; and at least one platen arranged to face the at least one inkjet head and having a protrusion, the protrusion provided on a surface of the at least one platen facing the at least one inkjet head and configured to support a convex portion in the wave shape of the deformed sheet, the at least one platen configured to support the sheet while keeping the sheet deformed in the wave shape, wherein the at least one stiffening conveyor comprises:

a conveyance roller elongated in the width direction; and stiffening rollers arranged along the width direction in such a zigzag pattern that the stiffening rollers are in contact with the conveyance roller at alternately upstream and downstream positions in the conveyance direction, the stiffening rollers configured to convey the sheet by nipping the sheet together with the conveyance roller while deforming the sheet into the wave shape.

4. The inkjet printer according to claim 2, wherein the first stiffening conveyor comprises:

a first conveyance roller elongated in the width direction; and first stiffening rollers arranged along the width direction in such a zigzag pattern that the first stiffening rollers are in contact with the first conveyance roller at alternately upstream and downstream positions in the conveyance direction, the first stiffening rollers configured to convey the sheet by nipping the sheet together with the first conveyance roller while deforming the sheet into the first wave shape, and the second stiffening conveyor comprises:

a second conveyance roller elongated in the width direction; and second stiffening rollers arranged along the width direction in such a zigzag pattern that the second stiffening rollers are in contact with the second conveyance roller at alternately upstream and downstream positions in the conveyance direction, the second stiffening rollers configured to convey the sheet by nipping the sheet together with the second conveyance roller while deforming the sheet into the second wave shape.

5. An inkjet printer comprising:

at least one inkjet head configured to eject ink to a sheet and print an image;

at least one stiffening conveyor configured to convey the sheet toward the at least one inkjet head in a conveyance direction while stiffening the sheet by deforming the sheet into a wave shape in a width direction orthogonal to the conveyance direction; and at least one platen arranged to face the at least one inkjet head and having a protrusion, the protrusion provided on a surface of the at least one platen facing the at least one inkjet head and configured to support a convex portion in the wave shape of the deformed sheet, the at least one platen configured to support the sheet while keeping the sheet deformed in the wave shape, wherein the at least one stiffening conveyor comprises:

a conveyance roller with elastic portions formed of elastic members and non-elastic portions formed of non-elastic members alternately arranged along the width direction;

first stiffening rollers arranged to be in contact with the elastic portions of the conveyance roller; and second stiffening rollers arranged to be in contact with the non-elastic portions of the conveyance roller, and the at least one stiffening conveyor is configured to convey the sheet by nipping the sheet with the conveyance roller, the first stiffening rollers, and the second stiffening rollers while deforming the sheet into the wave shape by pushing the sheet into the elastic portions with the first stiffening rollers.

6. The inkjet printer according to claim 2, wherein the first stiffening conveyor comprises:

a first conveyance roller with elastic portions formed of elastic members and non-elastic portions formed of non-elastic members alternately arranged along the width direction;

first stiffening rollers arranged to be in contact with the elastic portions of the first conveyance roller; and second stiffening rollers arranged to be in contact with the non-elastic portions of the first conveyance roller, and the first stiffening conveyor is configured to convey the sheet by nipping the sheet with the first conveyance roller, the first stiffening rollers, and the second stiffening rollers while deforming the sheet into the first wave shape by pushing the sheet into the elastic portions with the first stiffening rollers, the second stiffening conveyor comprises:

a second conveyance roller with elastic portions formed of elastic members and non-elastic portions formed of non-elastic members alternately arranged along the width direction;

third stiffening rollers arranged to be in contact with the elastic portions of the second conveyance roller; and fourth stiffening rollers arranged to be in contact with the non-elastic portions of the second conveyance roller, and the second stiffening conveyor is configured to convey the sheet by nipping the sheet with the second conveyance roller, the third stiffening rollers, and the fourth stiffening rollers while deforming the sheet into the second wave shape by pushing the sheet into the elastic portions with the third stiffening rollers.

* * * * *